US006752199B2

(12) United States Patent
Ban et al.

(10) Patent No.: US 6,752,199 B2
(45) Date of Patent: Jun. 22, 2004

(54) REDUCTION CASTING METHOD, REDUCTION CASTING APPARATUS AND MOLDING DIE USING SAME

(75) Inventors: Keisuke Ban, Nagano-ken (JP); Koichi Ogiwara, Nagano-ken (JP); Akira Sunohara, Nagano-ken (JP)

(73) Assignee: Nissin Kogyo Co., Ltd., Nagano-ken (JP)

( * ) Notice: Subject to any disclaimer, the term of this patent is extended or adjusted under 35 U.S.C. 154(b) by 0 days.

(21) Appl. No.: 10/105,377

(22) Filed: Mar. 26, 2002

(65) Prior Publication Data

US 2002/0139505 A1 Oct. 3, 2002

(30) Foreign Application Priority Data

Mar. 30, 2001 (JP) ..... P.2001-101011

(51) Int. Cl.[7] ..... B22D 23/00; B22C 9/08
(52) U.S. Cl. ..... 164/133; 164/359; 164/57.1
(58) Field of Search ..... 164/133–136, 164/335–337, 359–360, 57.1

(56) References Cited

U.S. PATENT DOCUMENTS 2,770,860 A * 11/1956 Webbere ..... 164/68.1
2,830,894 A * 4/1958 Spedding et al. ..... 75/399
3,680,628 A * 8/1972 McLean ..... 164/362
3,815,665 A * 6/1974 Baur ..... 164/359
4,072,180 A * 2/1978 Hoult ..... 164/130
5,275,263 A * 1/1994 Mezger ..... 164/95
6,171,363 B1 * 1/2001 Shekhter et al. ..... 75/369
6,244,328 B1 * 6/2001 Grolla ..... 164/359

FOREIGN PATENT DOCUMENTS

| | | |
|---|---|---|
| DE | 197 20 183 | * 11/1998 |
| JP | 03-230843 | 10/1991 |
| JP | 2000-280063 | * 10/2000 |

* cited by examiner

*Primary Examiner*—Kuang Y. Lin
(74) *Attorney, Agent, or Firm*—McGuireWoods LLP

(57) ABSTRACT

A reduction casting method, in which a molten metal is poured into a cavity of a molding die and casting is performed while the oxide film formed on the surface of the molten metal is reduced by allowing the molten metal and the reducing compound to be contacted with each other in the cavity of the molding die, is characterized in that, at the time the molten metal is poured into the cavity, it is done while it is allowed to be in a turbulent flow.

5 Claims, 4 Drawing Sheets

REDUCTION CASTING METHOD, REDUCTION CASTING APPARATUS AND MOLDING DIE USING SAME

BACKGROUND OF THE INVENTION

1. Field of the Invention

The present invention relates to a reduction casting method and reduction casting apparatus in which casting is performed while an oxide film formed on a surface of molten metal is reduced and, further, a molding die for use in an aluminum reduction casting method.

2. Description of the Related Art

There are various types of casting methods, but a gravity casting method has many advantages such as a favorable quality of a cast product, a simplicity of a molding die and the like. FIG. 5 shows an example of a molding die for use in casting aluminum by the gravity casting method. The molding die 100 is made of metal and has a split-type constitution including a lower mold 102*a* and an upper mold 102*b*. These two molds 102*a* and 102*b* form a cavity 104 in which a cast product having a desired shape is cast.

In the upper mold 102*b*, a feeder head portion 108 is formed between a sprue 106 from which a molten metal of aluminum, an alloy thereof or the like is poured and the cavity 104, and also an air-vent hole 110 is formed for discharging an air present in the cavity 104 at the time the molten metal is poured into the cavity 104.

When the molten metal is solidified, shrinkage of about 3% is generated. For this feature, the shrinkage generated by solidifying the molten metal poured in the cavity 104 appears as a defect such as a shrinkage hole or the like in an obtained cast product. When the molten metal filled in the cavity 104 is shrunk as being solidified, the feeder head portion 108 arranged in the molding die 100 shown in FIG. 5 replenishes the molten metal into the cavity 104 by a force of gravity to prevent the defect such as the shrinkage hole or the like from being generated. Since such a replenishing action of the molten metal from the feeder head portion 108 to the cavity 104 is performed by a force of gravity of the molten metal filled in the feeder head portion 108, a conventional casting apparatus secures a large capacity as the feeder head portion 108.

This is because, since a flowing property of the molten metal in the molding die in the casting apparatus is low, it is necessary to allow a weight of the feeder head portion 108 to be large thereby forcibly replenishing the molten metal into the cavity 104. For example, in a case that aluminum is cast, since aluminum is extremely easily oxidized, there is a problem that an aluminum oxide film is formed on a surface of the molten metal to decrease the flowing property of the molten metal. For this reason, a coating agent which aims for enhancing the flowing property of the molten metal is sometimes applied on a surface of an inner wall of the cavity 104.

With reference to such a method of casting aluminum as described above, the present applicant has proposed (in Japanese Patent Laid-Open No. 280063/2000) an aluminum casting method which can enhance the flowing property of aluminum without using the coating agent to obtain an aluminum cast product having a favorable outward appearance. This aluminum casting method, as shown in FIG. 6, is characterized in that, after magnesium-nitrogen compound ($Mg_3N_2$) being a reducing compound, is introduced into the cavity 104 of the molding die 100, molten metal of aluminum or an alloy thereof is poured into the cavity 104 to be cast. The magnesium-nitrogen compound has an action to reduce an oxide film formed on a surface of the molten metal of aluminum or the alloy thereof and, by this action, a surface tension of the molten metal is decreased to enhance the flowing property and a running property of the molten metal and to eliminate a surface fold and the like whereupon high-quality casting can be performed.

In the gravity casting method, in order to prevent air or an oxide from being entrained at the time of filling the molten metal in the cavity, the molten metal is filled in the cavity by allowing it to be in a state of a laminar flow. In order to fill the molten metal in the cavity in a state of the laminar flow, in a conventional molding die, a gate which connects the sprue and the cavity is allowed to be large whereupon the molten metal is poured into the cavity from a lower surface thereof such that a surface of the molten metal is gradually raised to prevent a turbulent flow from being generated as much as possible. The reason for allowing a diameter of the feeder head portion 108 to be large in the molding die 100 according to FIG. 5 is that an action of the feeder head by the molten metal in the feeder head portion 108 is secured and entrainment of the air or an oxide is prevented as much as possible at the time the molten metal is poured into the cavity 104. Further, in order to pour the molten metal in a state of the laminar flow, a method of pouring the molten metal while the molding die is tilted has widely been used.

As described above, in the gravity casting method, there is a problem that, since the gate is allowed to be large to prevent the turbulent flow from being generated at the time of pouring the molten metal and there is a restriction that the gate is arranged in a position where pouring the molten metal is easily performed by the laminar flow, a degree of freedom of the molding die or the apparatus is regulated. Further, there is a problem that the apparatus becomes large and complicated in a case in which a tilting-type molten metal pouring operation is performed. Furthermore, the yield by the conventional gravity casting method is ordinarily from 50% to 60%, which is hardly favorable in comparison with other casting methods.

SUMMARY OF THE INVENTION

The present invention is attained in order to solve such problems of the conventional gravity casting method as described above and has an object to provide a high-quality and efficient casting method by utilizing a reduction casting method which performs casting while an oxide film formed on a surface of the molten metal is reduced by making use of the above-described reducing compound. In a case of the reduction casting method, since the oxide film formed on the surface of the molten metal is reduced, a flowing property of the molten metal is enhanced and a running property thereof is improved whereby the filling property of the molten metal in the cavity becomes favorable. The present invention is to provide a reduction casting method which enables an action of such a reduction method as described above to be more effectively exerted, a reduction casting apparatus and a molding die advantageous to an aluminum reduction casting method.

In order to achieve the above-described object of the present invention, constitutions described below are provided.

Namely, according to the present invention, there is provided a reduction casting method, in which molten metal is poured into a cavity of a molding die and casting is performed while an oxide film formed on a surface of the molten metal is reduced by allowing the molten metal and a reducing compound to be contacted with each other in the cavity of the molding die, comprising the step of:

pouring the molten metal into the cavity while it is allowed to be in a turbulent flow in the cavity at the time the molten metal is poured into the cavity.

Further, according to the present invention, there is provided a reduction casting method, in which molten metal is poured into a cavity of a molding die and casting is performed while an oxide film formed on a surface of the molten metal is reduced by allowing the molten metal and a reducing compound to be contacted with each other in the cavity of the molding die, comprising the steps of:

arranging a runner having a smaller flow passage diameter than that of a feeder head portion in an upstream side of the cavity; and adjusting a flow rate of the molten metal to be poured into the cavity by adjusting the flow passage diameter of the runner.

Further, according to the prevent invention, casting is performed while molten aluminum or a molten alloy thereof is used as the molten metal and a magnesium-nitrogen compound, which is obtained by introducing a magnesium gas and a nitrogen gas into the cavity and, then, allowing the magnesium gas and the nitrogen gas to be reacted with each other therein, is used as the reducing compound.

Further, according to the present invention, there is provided a reduction casting apparatus, in which molten metal is poured into a cavity of a molding die and casting is performed while an oxide film formed on a surface of the molten metal is reduced by allowing the molten metal and a reducing compound to be contacted with each other in the cavity of the molding die, comprising a runner having a smaller flow passage diameter than that of a feeder head portion arranged in an upstream side of the cavity.

Further, according to the present invention, the feeder head portion is arranged just upstream of the cavity, and the runner is connected with the feeder head portion.

Further, according to the present invention, a molten metal reservoir for storing the molten metal is arranged at a sprue which is arranged in an upstream side of the runner, and an opening/closing member for opening/closing a communication between the molten metal reservoir and the runner is arranged. By these arrangements, the molten metal stored in the molten metal reservoir can be poured into the cavity at a time; on this occasion, the molten metal can be poured into the cavity with an increased flow rate.

Further, according to the present invention, a surface of an inner wall of the runner is subjected to a heat insulating treatment or formed by a heat insulating material selected from the group consisting of: ceramic, an alumina board and other heat insulating materials. By this arrangement, a flowing property of the molten metal in the runner becomes favorable whereby the flow rate of the molten metal at the time of being poured into the cavity can be increased.

Further, according to the present invention, there is provided a molding die for use in an aluminum reduction casting method, in which molten metal of aluminum or an alloy thereof is poured into a cavity and casting is performed while an oxide film formed on a surface of the molten metal is reduced by allowing a magnesium-nitrogen compound which is prepared by allowing a magnesium gas and a nitrogen gas to be reacted with each other and the molten metal to be contacted with each other in the cavity, wherein a runner having a smaller flow passage diameter than that of a feeder head portion is arranged in an upstream side of the cavity.

DETAILED DESCRIPTION OF THE PREFERRED EMBODIMENTS

Hereinafter, preferred embodiments of the present invention will be described in detail with reference to accompanying drawings.

Figure 1:
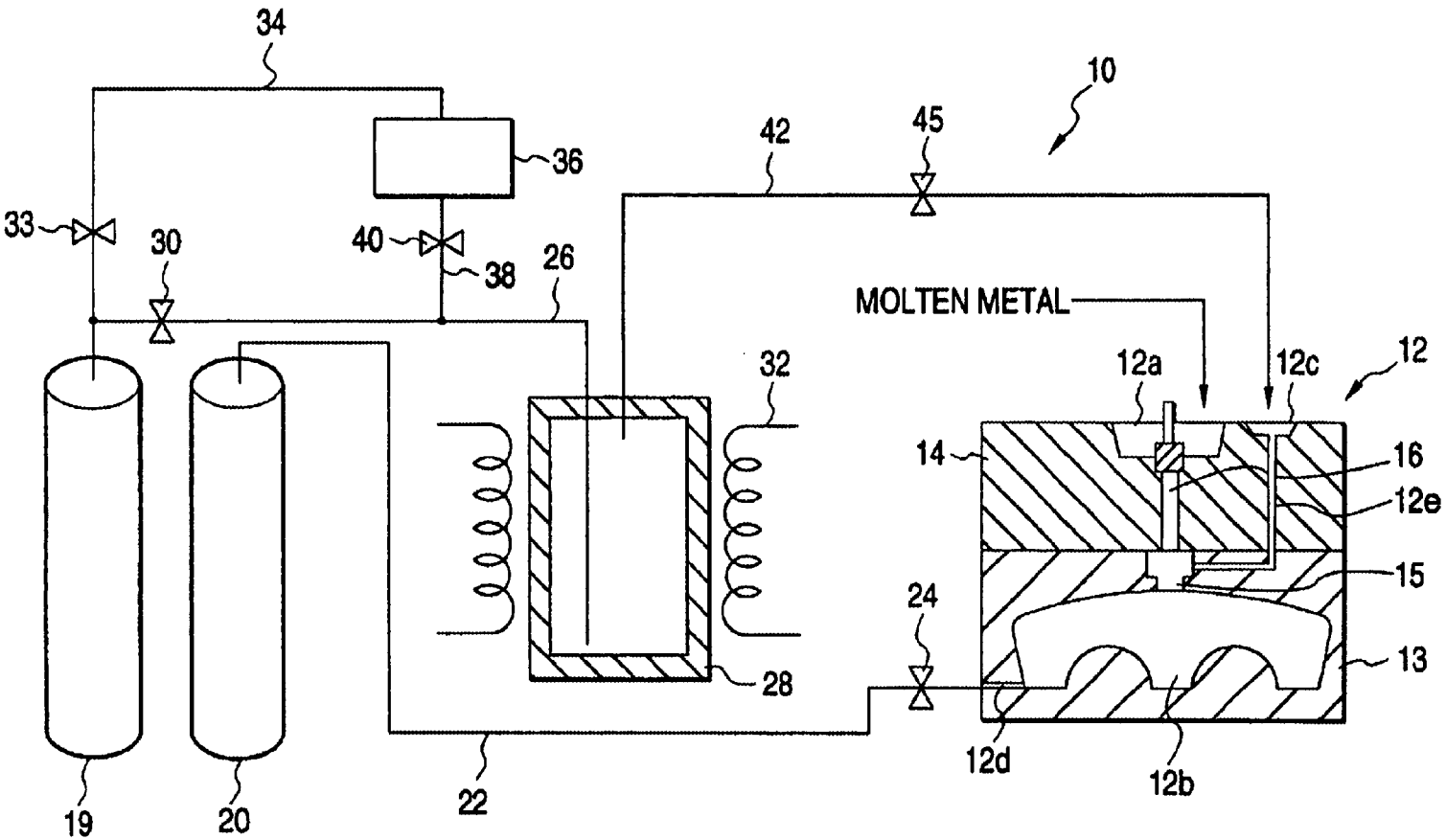
FIG. 1 is an explanatory diagram showing an entire constitution of a casting apparatus according to the present invention.

FIG. 1 is an explanatory diagram, showing an entire constitution of a casting apparatus 10 according to the present invention, which illustrates an application thereof for aluminum casting. A reference number 12 represents a molding die in which molten metal of aluminum or an alloy thereof is filled to produce a cast product. The molding die 12 includes a sprue 12*a,* a cavity 12*b* and a runner 16 which communicates the sprue 12*a* and the cavity 12*b* via a feeder head portion 15.

The molding die 12 is connected with a steel cylinder 20 containing a nitrogen gas by a piping 22 and, by opening a valve 24 of the piping 22, the nitrogen gas is poured from a nitrogen gas-introducing port 12*d* of the molding die 12 into the cavity 12*b* to allow an inside of the cavity 12*b* to be in a nitrogen-gas atmosphere, that is, in a substantially non-oxygen atmosphere.

Further, a steel cylinder 19 containing an argon gas is connected with a furnace 28 as a generator which generates a metallic gas by a piping 26 and, by opening a valve 30 of the piping 26, the argon gas is poured into the furnace 28 which is heated by a heater 32; on this occasion, in order to generate a magnesium gas as a metallic gas, a temperature inside the furnace 28 is set to be 800° C. or more at which magnesium powders are sublimed. A quantity of the argon gas to be poured into the furnace 28 can be adjusted by the valve 30.

The steel cylinder 19 containing the argon gas is connected with a tank 36 containing magnesium powders by a piping 34 in which a valve 33 is interposed. The tank 36 is connected with the piping 26 positioned in a downstream side of the valve 30 by a piping 38. A valve 40 which controls a quantity of the magnesium powders to be supplied to the furnace 28 is interposed in the piping 38. The furnace 28 is connected with a metallic gas-introducing port 12*c* of the molding die 12 via a piping 42; on this occasion, the metallic gas which has been gasified in the furnace 28 is introduced into the cavity 12*b* from the metallic gas-introducing port 12*c* via a metallic gas-introducing passage 12*e*. A valve 45 which is interposed in the piping 42 aims for adjusting a quantity of the metallic gas to be supplied into the cavity 12*b* of the molding die 12.

Figure 2:
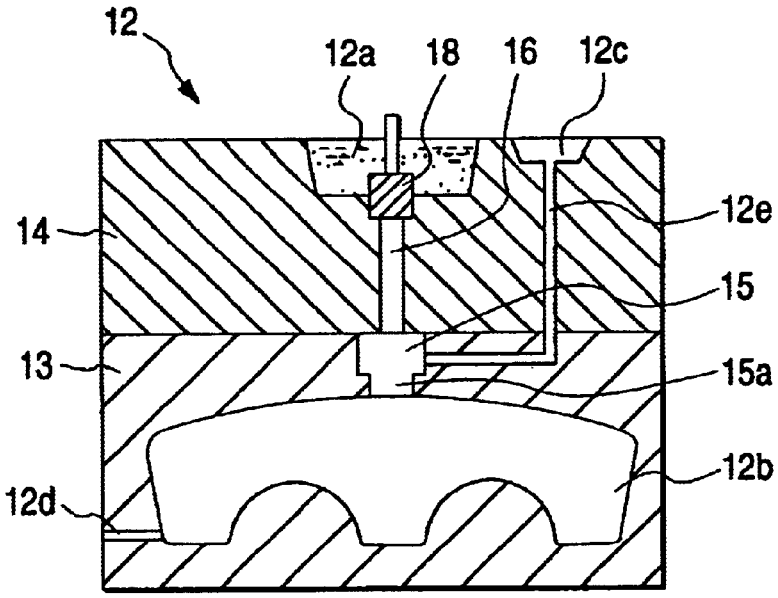
FIG. 2 is a cross-sectional view of a constitution of a molding die to be used in a casting apparatus.

FIG. 2 shows a constitution of the molding die 12 in an enlarged manner. The molding die 12 is structured by a combination of a mold portion 13 made of metal and an adaptor 14 made of ceramic such as calcium sulfate; on this occasion, the mold portion 13 and the adaptor 14 are arranged such that they can be divided at an interface therebetween. Further, the mold portion 13 is formed in a split type such that a cast product can be removed from the mold by opening the mold after the molten metal is solidified in the cavity 12*b*.

A feeder head portion 15 is arranged in a head part of the cavity 12*b* of the mold portion 13. The feeder head portion 15 and the cavity 12*b* are connected with each other via a gate 15*a* having a smaller diameter than that of the feeder head portion 15.

In the molding die 12 according to the present embodiment, a capacity of the feeder head portion 15 arranged in the molding portion 13 is by far smaller than that of the feeder head portion arranged in the molding die used in the conventional gravity casting apparatus. In the present embodiment, the reason why the feeder head portion 15 can be formed to be of such a small capacity is that, since a running property of the molten metal is extremely favorable at the time of pouring the molten metal in a case in which casting is performed by using the reduction casting method, the molten metal can easily be filled in the cavity without making use of the feeder head action. Therefore, in the present embodiment, the capacity of the feeder head portion 15 to be formed in the molding portion 13 may be set in a size enough to replenish the molten metal into the shrinkage hole which is possibly formed at the time the molten metal is solidified in the cavity 12*b*.

The runner 16 is arranged in the adaptor 14 for allowing the cavity 12 and the sprue 12*a* to communicate with each other via the feeder head portion 15 and also for adjusting a flow rate and a flow quantity of the molten metal to be poured from the sprue 12*a* into the cavity 12*b*. In the present embodiment, the runner 16 is arranged such that it extends vertically downward to the feeder head portion 15 and the molten metal is perpendicularly dropped from the sprue 12*a* to the cavity 12*b*. The reason why a flow passage diameter of the runner 16 is set to be smaller than that of the feeder head portion 15 is that the flow rate of the molten metal to be poured into the cavity 12*b* is brought to be faster than that in a case in which the molten metal is poured from the sprue 12*a* to the cavity 12*b* simply via the feeder head portion 15. The flow rate and the flow quantity of the molten metal at the time of pouring it from the runner 16 to the cavity 12*b* can be controlled by adjusting the flow passage diameter, length of the runner 16 and the like.

Further, in order to make it possible that the molten metal can be poured at a predetermined flow rate when it is poured from the sprue 12*a* to the cavity 12*b*, in the present embodiment, a molten metal reservoir which can store a predetermined quantity of the molten metal is arranged in the sprue 12*a*, an opening/closing stopper 18 as an opening/closing member which opens or closes a communication between the molten metal reservoir and the runner 16 is arranged in an opening portion of the runner 16, pouring the molten metal into the cavity 12*b* is started by opening the opening/closing stopper 18 when a predetermined quantity of the molten metal is filled in the sprue 12*a*, and such pouring of the molten metal into the cavity 12*b* is executed while the molten metal is being replenished such that a surface of the molten metal in the molten metal reservoir is maintained at a predetermined height.

Further, in order to improve the flowing property of the molten metal when it passes through the runner 16, effective is a method in which an inner surface of the runner 16 is subjected to a heat insulating treatment by using the coating agent having a heat insulating property, or the adaptor 14 is formed by using a heat insulating material such as ceramics, an alumina board or the like thereby increasing the heat insulating property of the runner 16 higher than that of the mold portion 13 in which the cavity 12*b* is formed.

As the molding die 12 shown in the present embodiment, when the sprue 12*a* and the cavity 12*b* are communicated with each other by the runner 16 and, then, the molten metal is poured into the cavity 12*b* via the runner 16, the flow rate of the molten metal at the time of pouring it, as described above, becomes fast whereupon the molten metal is poured in a state of a turbulent flow. In the present embodiment, the reason why a constitution in which the molten metal is poured into the cavity 12*b* while the runner 16 is set to have a small diameter and the flow rate of the molten metal is increased is arranged is that the molten metal is poured while the turbulent flow is actively generated in the molten metal in the cavity 12*b*. As described above, a method of pouring the molten metal while generating the turbulent flow at the time of pouring the molten metal into the cavity 12*b* can extremely favorably be applied to a casting method using the reduction casting method.

A reduction casting of aluminum by using the casting apparatus 10 as shown in FIG. 1 is performed as described below.

Firstly, the valve 24 is opened and a nitrogen gas is introduced from the steel cylinder 20 containing the nitrogen gas into the cavity 12*b* of the molding die 12 via the piping 22 to purge an air present in the cavity 12*b* by the nitrogen gas. The air present in the cavity 12*b* is discharged through an exhaust hole (not shown) whereupon an inside of the cavity 12*b* becomes in a nitrogen gas atmosphere, that is, a substantially non-oxygen atmosphere. Thereafter, the valve 24 is closed once.

While the air present in the cavity 12*b* of the molding die 12 is being purged, the valve 30 is opened and the argon gas is poured from the steel cylinder 19 containing the argon gas to into the furnace 28 to allow an inside of the furnace 28 to be in a non-oxygen condition.

Next, the valve 30 is closed and, then, the valve 40 is opened to send magnesium powders contained in the tank 30 into the furnace 28 by an argon gas pressure. The furnace 28 is beforehand heated by a heater 32 to a temperature of 800° C. or more at which the magnesium powders are sublimed. With this arrangement, the magnesium powders sent into the furnace 28 are sublimed to be a magnesium gas.

Next, the valve 40 is closed and, then, the valve 30 and the valve 45 are opened to pour the magnesium gas from the metallic gas introducing port 12*c* of the molding die 12 into the cavity 12*b* via the metallic gas introducing passage 12*e* while adjusting a pressure and a flow rate of the argon gas.

After the magnesium gas is poured into the cavity 12*b*, the valve 45 is closed and the valve 24 is opened to pour the nitrogen gas from the nitrogen gas introducing port 12*d* into the cavity 12*b*. By pouring the nitrogen gas into the molding die 12, the magnesium gas and the nitrogen gas are allowed to be reacted with each other in the cavity 12*b* to generate the magnesium-nitrogen compound ($Mg_3N_2$). The thus-generated magnesium-nitrogen compound is deposited on the surface of the inner wall of the cavity 12*b* as a powder.

The nitrogen gas is poured into the cavity 12*b* while the pressure and the flow rate thereof are appropriately adjusted. The nitrogen gas may be preheated before being poured into the cavity 12 so as to allow the nitrogen gas and the magnesium gas to be easily reacted with each other, whereby a temperature of the molding die 12 is prevented from being decreased.

In a state in which the magnesium-nitrogen compound is deposited on the surface of the inner wall of the cavity 12*b*, the molten metal 50 of aluminum is poured into the sprue 12*a*. At the time of such pouring of the molten metal 50, the runner 16 is closed by the opening/closing stopper 18 and, after a predetermined quantity of the molten metal 50 is stored in the molten metal reservoir arranged in the sprue 12*a,* the opening/closing stopper 18 is opened to allow the molten metal 50 to be flown down from the sprue 12*a* whereby the molten metal 50 can be poured into the cavity 12*b* with a heightened flow rate thereof.

Figure 3:
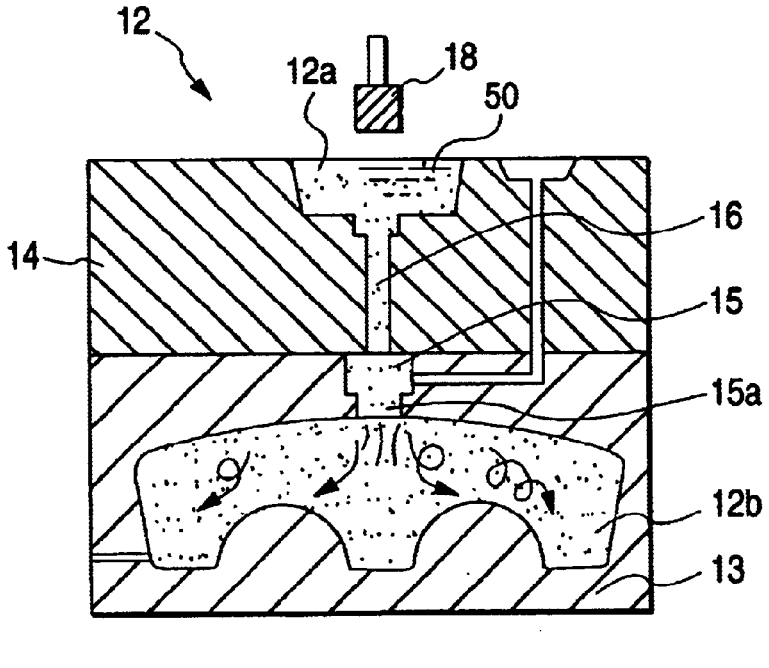
FIG. 3 is an explanatory diagram showing a state in which molten metal is poured into a molding die.

FIG. 3 shows a state in which the molten metal 50 is poured from the sprue 12*a* to the cavity 12*b*. The molten metal 50 is poured into the cavity 12*b* in a state in which the flow thereof is narrowed by allowing the molten metal 50 to pass through the runner 16 so as to increase the flow rate thereof.

The molten metal of aluminum which has been poured into the cavity 12*b* is contacted with the magnesium-nitrogen compound in the cavity 12*b,* an oxide film on the surface of the molten metal is deprived of oxygen by an action of the magnesium-nitrogen compound whereupon the surface of the molten metal is reduced to pure aluminum.

The molten metal of aluminum has a property that it is easily combined with oxygen to form an oxide film thereof and, by forming the oxide film, a running property thereof in the cavity 12*b* is hindered to cause a blow hole or a surface fold. To contrast, a method (reduction casting method) in which casting is performed while the molten metal of aluminum is allowed to contact the magnesium-nitrogen compound to reduce the oxide film formed on the surface of aluminum, is characterized in that the oxide film formed on the surface of the molten metal is reduced to be a surface of pure aluminum whereby it is prevented that the oxide film is formed to increase the surface tension of the molten metal, a running property thereof becomes favorable, the molten metal can be filled in the cavity 12*b* in a short period of time to eliminate a portion unfilled with the molten metal and, as a result, a favorable cast product without having a surface fold and the like can be obtained.

In the present embodiment, by pouring the molten metal into the cavity 12*b* via the runner 16, the molten metal of aluminum is poured into the cavity 12*b* in a state of the turbulent flow. When the molten metal 50 is poured in the cavity 12*b* in such a turbulent flow as described above, a reduction reaction between the magnesium-nitrogen compound and the molten metal 50 of aluminum is accelerated, the flowing property of the molten metal of aluminum is heightened and, as a result, it becomes possible that the molten metal 50 is filled in the cavity 12*b* in a shorter period of time than before. As described above, when the molten metal 50 is poured in the cavity 12*b* in a state of the turbulent flow, the reduction reaction of the magnesium-nitrogen compound even to the molten metal 50 which is successively poured into the cavity 12*b* is maintained and acted thereon to enable a favorable casting to be executed. FIG. 3 shows a state in which the molten metal 50 is poured in a state of the turbulent flow.

When the casting is executed by the reduction casting method, the flowing property of aluminium becomes extremely favorable whereupon filling of the molten metal in the cavity 12*b* is completed in a few seconds. Therefore, at the time the molten metal is poured in the cavity 12*b* via the runner 16 and the molten metal 50 is filled in the feeder head portion 15, the runner 16 is closed by the opening/closing stopper 18 and, then, the molten metal in the cavity 12*b* is allowed to be solidified.

In a case in which the reduction casting method is used, since filling of the molten metal in the cavity 12*b* is completed in a few seconds, it is not necessary to maintain the temperature of the mold high in order to prevent the molten metal in the cavity 12*b* from being solidified as in a case of a conventional casting method. Therefore, solidification of the molten metal filled in the cavity 12*b* is completed in a short period of time. In fact, in a case in which the reduction casting method according to the present embodiment is used, casting can be executed while the molding die 12 is maintained in room temperature whereby a favorable cast product without having a surface fold, a blow hole and the like can be obtained.

In the casting apparatus according to the above-described embodiment, by using the molding die 12 in which the runner 16 is connected with the feeder head portion 15 arranged just upstream of the cavity 12*b* , the molten metal to be poured from the runner 16 is finally filled in the feeder head portion 15 and the casting can be performed while the shrinkage hole to be possibly generated when the molten metal is solidified is replenished with the molten metal from the feeder head portion 15. Further, after the casting is performed, the cast product can be obtained by separating the feeder head portion 15. In a case of the reduction casting method, since the capacity of the feeder head portion 15 can be set to be small, it is an easy work to separate a metal solidified in the feeder head portion 15 after the molten metal is solidified.

Figure 4:
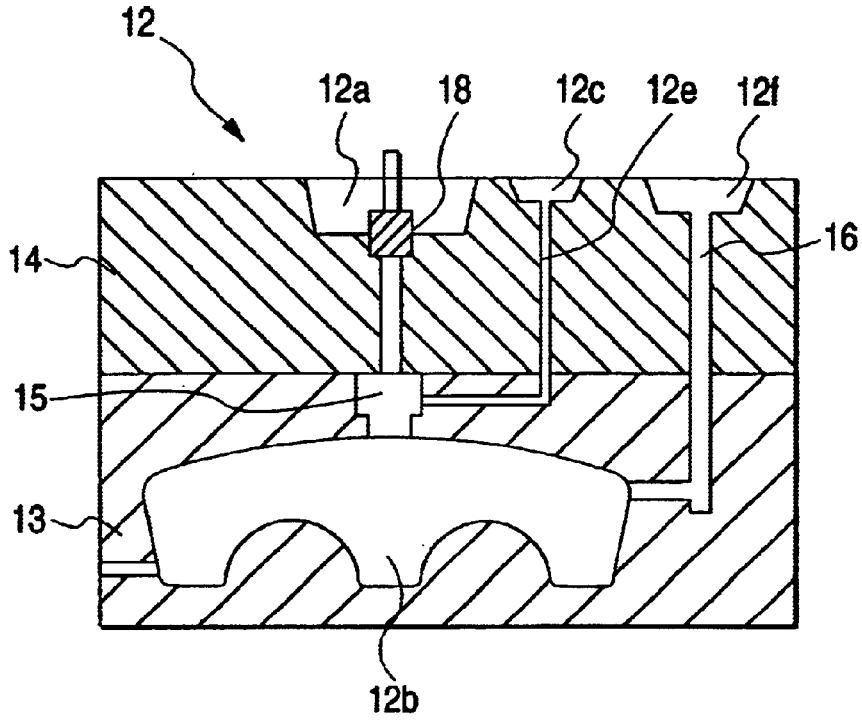
FIG. 4 is a cross-sectional view of another example of a constitution of a molding die to be used in a casting apparatus.
Figure 5:
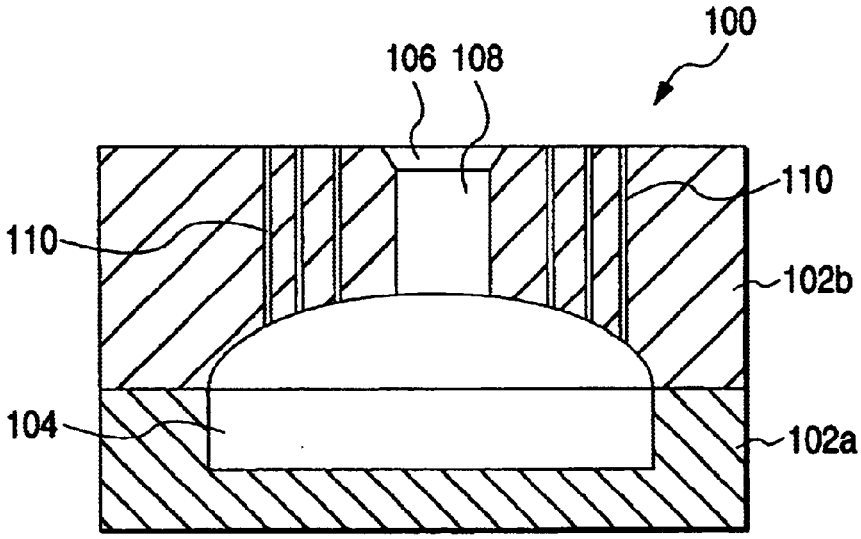
FIG. 5 is a cross-sectional view of an example of a constitution of a molding die to be used in a conventional casting apparatus.
Figure 6:
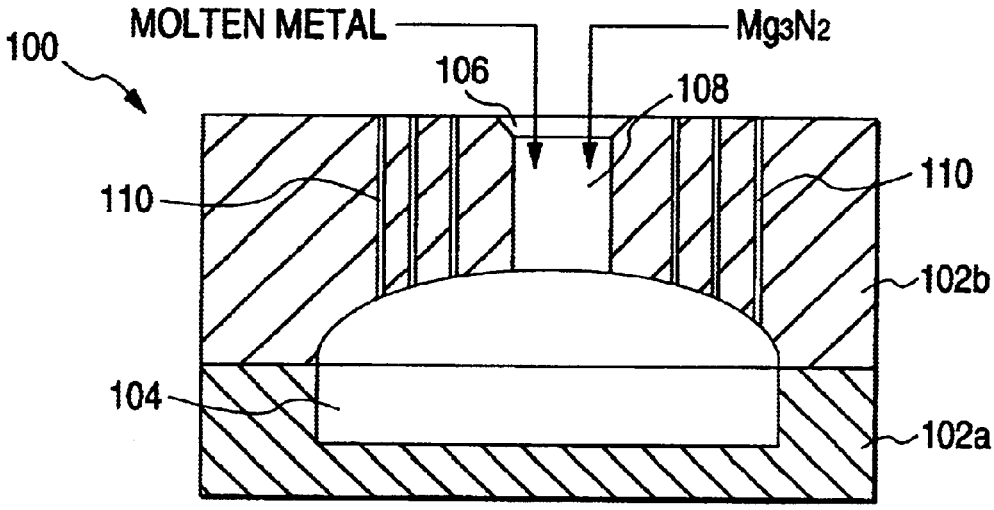
FIG. 6 is an explanatory diagram showing a method of casting by a reduction casting method of aluminum.

Further, a position of the runner 16 arranged in the molding die 12 can be appropriately selected in accordance with products so long as it is positioned such as to be communicated with the cavity 12*b*. FIG. 4 shows another embodiment of the molding die 12 to be used in the casting apparatus 10. This molding die 12 is characterized in that, aside from a molten metal passage (a first runner) which communicates with the cavity 12*b* via the feeder head portion 15, another molten metal passage which connects the runner 16 (a second runner) directly with the cavity 12*b* is arranged. As described above, the molding die 12 according to the present embodiment is characterized in that the molten metal 50 is poured such that it becomes in a turbulent flow in the cavity 12*b*. Therefore, in the molding die 12 as shown in FIG. 4, the runner 16 is directly connected with the cavity 12*b* in an upstream side of a position from which the molten metal 50 is poured into the cavity 12*b* and, on this occasion, a diameter of the runner 16 is allowed to be smaller than that of the feeder head portion 15 to enable a flow rate of the molten metal at the time of being poured to be increased whereupon the molten metal 50 can be poured while it is allowed to be in a turbulent flow in the cavity 12*b*.

When the molding die 12 according to the present embodiment is used, in a same manner as described above, after the magnesium-nitrogen compound is deposited on the surface of the inner wall of the cavity 12*b,* firstly, the molten metal 50 of aluminum is poured into a sprue 12*f* and, then, poured into the cavity 12*b* therefrom through the runner 16. When the molten metal is poured into the cavity 12*b* through the runner 16, it is done in a state of the turbulent flow, the reduction reaction between the magnesium-nitrogen compound and the oxide film on the surface of the molten metal in the cavity 12*b* is promoted and the cavity is filled with the molten metal in a state of an enhanced flowing property thereof.

On the other hand, the molten metal 50 of aluminum is poured also into the sprue 12*a* at the same time or a little later than it is poured into the sprue 12*f* and, then, the molten metal 50 of aluminum thus-poured into the sprue 12*a* is poured into the cavity 12*b* via the feeder head portion 15. Finally, the molten metal is solidified while preventing the shrinkage hole to be generated at the time the molten metal is solidified by using the molten metal 50 filled in the feeder head portion 15. In a case in which the reduction casting method is used, since the running property of the molten metal is extremely favorable, it is possible to perform casting almost without arranging the feeder head portion 15.

As described above, it becomes possible to perform the favorable reduction casting by arranging the runner 16 in accordance with products or optionally arranging the feeder head portion 15.

In the reduction casting method, it is an important factor that the oxide film formed on the surface of the molten metal is reduced to be pure metal and, then, the resultant pure metal is allowed to fill the cavity. In each of the above-described embodiments, the reason why the molten metal 50 of aluminum is poured into the cavity 12 via the runner 16 and, at this time, this pouring is performed while the molten metal 50 is allowed to be in the turbulent flow is that the reduction reaction is allowed to be promoted and, by this promotion of the reduction reaction, the flowing property of the molten metal is enhanced and a wetting property and a running property of the molten metal are allowed to be favorable to enable an advantageous cast product excellent in a transferring property (flatness) relative to the surface of the inner wall of the cavity 12*b* and having no surface fold and the like.

In a case of the molding die in which the runner is arranged in an upstream side of the cavity and, then, the molten metal is poured into the cavity via the runner, it is possible to adjust the flow rate and flow quantity of the molten metal into the cavity by means of adjusting the diameter and/or length of the flow passage of the runner. Therefore, by appropriately setting the diameter and/or length of the flow passage of the runner when the molding die is designed, it becomes possible to perform casting by pouring the molten metal into the cavity at an optimum flow rate and flow quantity thereof in accordance with each product.

Further, as described above, in a case of the reduction casting method, since the running property of the molten metal is favorable thereby easily filling the cavity of the molding die with the molten metal, it is not necessary to keep the molding die to be warmed as in the molding die used in the conventional casting apparatus and, since the heating device is not necessary in an apparatus constitution, the constitution of the casting apparatus can be simplified; further, there is an advantage that, since it is not necessary to apply the coating agent on the molding die, the constitution of the molding die itself can also be simplified.

Heretofore, the casting method which uses the molten metal of aluminum or an alloy thereof as the molten metal has been described, but the present invention is not limited thereto and can be applied to a molding method which uses the molten metal of any other metal such as magnesium, iron or the like or an alloy thereof.

In the reduction casting method, the reduction casting apparatus and the molding die to be used therein according to the present invention, as described above, by performing a completely different method of pouring the molten metal from that of the conventional gravity casting method in the point that the molten metal is poured while the molten metal is allowed to be in a turbulent flow at the time of pouring the molten metal into the cavity, the reduction reaction between the reducing compound to be generated in the cavity and the oxide film on the surface of the molten metal is promoted and the flowing property and running property of the molten metal in the cavity become favorable to obtain a favorable product without having a portion unfilled with the molten metal, the surface fold and the like. Further, since the flowing property and the running property of the molten metal become favorable, it is possible to enhance the yield of the product. Furthermore, with reference to the molding die, by arranging the runner in the upstream side of the cavity, a remarkable effect can be obtained such that favorable reduction casting can be performed by pouring the molten metal into the cavity while it is allowed to be in a turbulent flow and the like.

What is claimed is:

1. A gravity casting method, comprising the steps of:

pouring a molten metal into a cavity of a molding die;

reducing an oxide film formed on a surface of the molten metal by allowing the molten metal and a reducing compound to be contacted with each other in the cavity of the molding die; and solidifying the molten metal in the cavity, wherein, in the pouring step, the molten metal is poured into the cavity while it is allowed to be in a turbulent flow in the cavity.

2. The gravity casting method as set forth in claim 1, wherein a molten aluminum or a molten alloy thereof is used as the molten metal and a magnesium-nitrogen compound, which is obtained by introducing a magnesium gas and a nitrogen gas into the cavity and allowing the magnesium gas and the nitrogen gas to be reacted with each other therein, is used as the reducing compound.

3. A gravity casting method, comprising the steps of:

preparing a molding die including a cavity and a runner ranged in an upstream side of the cavity, the runner having a smaller flow passage diameter than tat of a feeder head portion; and pouring a molten metal into the cavity of the molding die by allowing the molten metal in a turbulent flow in the cavity;

reducing an oxide film formed on a surface of the molten metal by allowing the molten metal and a reducing compound to be contacted wit each other in the cavity of the molding die; and solidifying the molten metal in the cavity.

4. The gravity casting method as set forth in claim 3, wherein a molten aluminum or a molten alloy thereof is used as the molten metal and a magnesium-nitrogen compound, which is obtained by introducing a magnesium gas and a nitrogen gas into the cavity and allowing the magnesium gas and the nitrogen gas to be reacted with each other therein, is used as the reducing compound.

5. The gravity casting method as set forth in claim 3, wherein, in the pouring step, a flow rate of the molten metal to be poured into the cavity is adjusted prior to the pouring step by adjusting the flow passage diameter to a predetermined diameter.

* * * * *

UNITED STATES PATENT AND TRADEMARK OFFICE

CERTIFICATE OF CORRECTION

PATENT NO. : 6,752,199 B2
DATED : June 22, 2004
INVENTOR(S) : Keisuke Ban et al.

It is certified that error appears in the above-identified patent and that said Letters Patent is hereby corrected as shown below:

Column 10,
Line 41, delete “ranged” and insert -- arranged --.
Line 42, delete “tat” and insert -- that --.
Line 49, delete “wit” and insert -- with --.

Signed and Sealed this

Third Day of August, 2004

JON W. DUDAS
*Acting Director of the United States Patent and Trademark Office*